US007660542B2

(12) United States Patent
Hamahashi

(10) Patent No.: US 7,660,542 B2
(45) Date of Patent: Feb. 9, 2010

(54) IMAGE FORMING METHOD AND IMAGE FORMING APPARATUS FOR FORMING AN IMAGE ON A SURFACE OF A TRANSFER MEMBER

(75) Inventor: Shunsuke Hamahashi, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 32 days.

(21) Appl. No.: 12/007,703

(22) Filed: Jan. 15, 2008

(65) Prior Publication Data

US 2008/0181635 A1 Jul. 31, 2008

(30) Foreign Application Priority Data

Jan. 25, 2007 (JP) ..... 2007-014871

(51) Int. Cl.
*G03G 21/14* (2006.01)
*G03G 15/00* (2006.01)

(52) U.S. Cl. ..... 399/49

(58) Field of Classification Search ..... 399/49, 399/302, 308, 301
See application file for complete search history.

(56) References Cited

U.S. PATENT DOCUMENTS

| | | | | |
|---|---|---|---|---|
| 6,301,451 | B1 * | 10/2001 | Ando et al. | 399/38 |
| 6,356,735 | B1 * | 3/2002 | Hozumi | 399/395 |
| 6,529,695 | B2 * | 3/2003 | Katayanagi et al. | 399/49 |
| 7,151,248 | B2 * | 12/2006 | Harush et al. | 250/221 |
| 2007/0158895 | A1 | 7/2007 | Hamahashi | |
| 2007/0212141 | A1 | 9/2007 | Hamahashi | |

FOREIGN PATENT DOCUMENTS

| | | |
|---|---|---|
| JP | 11-065208 | 3/1999 |
| JP | 2001-215857 | 8/2001 |
| JP | 2002-244393 | 8/2002 |

* cited by examiner

*Primary Examiner*—Quana M Grainger
(74) *Attorney, Agent, or Firm*—IPUSA, PLLC

(57) ABSTRACT

In an image forming method, an intermediate transfer body made of an endless flexible member is rotated, and an image is formed on a surface of a transfer member by undergoing a secondary transfer of a developer image onto a second transfer position from the intermediate transfer body to the transfer member, the developer image undergoing a primary transfer onto a first transfer position from an image carrier to a surface of the intermediate transfer body.

14 Claims, 9 Drawing Sheets

IMAGE FORMING METHOD AND IMAGE FORMING APPARATUS FOR FORMING AN IMAGE ON A SURFACE OF A TRANSFER MEMBER

BACKGROUND OF THE INVENTION

1. Field of the Invention

The present invention generally relates to image forming methods and image forming apparatuses.

2. Description of the Related Art

An image forming apparatus having the following structure and mechanism is known. That is, toner images, as developer images, each formed on a photosensitive body (image carrier), are sequentially overlapped (superposed) on an endless belt intermediate transfer body at multiple times for primary transferring. Multicolor toner images formed by stacking the toner images on the intermediate transfer body undergo secondary transfer to a transfer member (for example, a transfer paper).

In such an image forming apparatus, timing when the toner images transferred onto a surface of the intermediate transfer body reach a secondary transferring position where the toner images undergo secondary transfer is matched with timing when the transfer member is conveyed to the secondary transferring position, so that secondary transferring can be achieved by matching a head end of the toner image on the surface of the intermediate transfer body with a head end of the transfer member.

The timing when the toner image transferred onto the surface of the intermediate transfer body reaches the secondary transferring position can be calculated based on a set value of the perimeter length of the intermediate transfer body. However, the perimeter length of the intermediate transfer body may be changed based on change of environment such as temperature change or humidity change or degradation with time.

If the perimeter length of the intermediate transfer body is changed so as to shift from the set value, an error may be generated between the timing when the toner image transferred onto the surface of the intermediate transfer body reaches the secondary transferring position and the timing when the transfer member is conveyed to the secondary transferring position. This may cause a mismatch of the head end of the toner image on the surface of the intermediate transfer body with the head end of the transfer member.

Especially, when an endless belt flexible member made of a material such as synthetic resin or rubber is used as the intermediate transfer body, such a material may be expanded with time due to creep phenomenon. In addition, an error between both timings may become large because expansion and contraction of the material based on the environmental change is large.

In the related art, a technique is suggested where a toner image transferred to an intermediate transfer belt is detected twice by a sensor while the intermediate transfer belt makes a round (one rotation); the variation of the perimeter length of the intermediate transfer belt is determined from the time interval of a detection signal; and a timing for conveying the transfer member to a secondary transfer position is changed according to the variation of the perimeter length of the intermediate transfer belt. See, for example, Japanese Laid-Open Patent Application Publication No. 2001-215857.

However, in the technique discussed in Japanese Laid-Open Patent Application Publication No. 2001-215857, it is necessary to make the intermediate transfer belt go around at least one time in order for the sensor to detect twice the toner image transferred to the intermediate transfer belt. Accordingly, the following problems may occur.

First, since image forming cannot be performed while the intermediate transfer belt makes a round, a time for image forming becomes long so that the productivity may be degraded.

In addition, before the toner image reaches a primary transfer position, it is necessary to remove toner remaining on the surface of the intermediate transfer belt after the previous secondary transfer. However, if the intermediate transfer belt makes a round while the toner image remains on the surface of the intermediate transfer belt, it is necessary to provide a mechanism for switching between removing or not removing the residual toner. This may cause an increase in cost and make the size of the apparatus large.

SUMMARY OF THE INVENTION

Accordingly, embodiments of the present invention may provide a novel and useful image forming method and an image forming apparatus solving one or more of the problems discussed above.

More specifically, the embodiments of the present invention may provide an image forming method and an image forming apparatus whereby position shift of a developer image undergoing secondary transfer to an image carrying medium can be prevented without causing an increase in cost or making the size of the apparatus large.

One aspect of the present invention may be to provide an image forming method whereby an intermediate transfer body made of an endless flexible member is rotated, and an image is formed on a surface of a transfer member by undergoing a secondary transfer of a developer image onto a second transfer position from the intermediate transfer body to the transfer member, the developer image undergoing a primary transfer onto a first transfer position from an image carrier to a surface of the intermediate transfer body, the image forming method including:

a step of detecting the developer image on the surface of the intermediate transfer body by a detecting part provided between the first transfer position and the second transfer position;

a step of determining a distance from the first transfer position to a detecting position by the detecting part based on a time period from a time when the developer image undergoes the primary transfer to a time when detection is made by the detecting part;

a step of estimating a moving distance necessary for moving the developer image having undergone the primary transfer onto the intermediate transfer body from the detecting position to the second transfer position based on a difference between the distance and a preset standard distance; and a step of adjusting time for conveying the transfer member to the second transfer position based on the moving distance.

Another aspect of the present invention may be to provide an image forming apparatus whereby an intermediate transfer body made of an endless flexible member is rotated, and an image is formed on a surface of a transfer member by undergoing a secondary transfer of a developer image onto a second transfer position from the intermediate transfer body to the transfer member, the developer image undergoing a primary transfer onto a first transfer position from an image carrier to a surface of the intermediate transfer body, the image forming apparatus including:

a detecting part configured to detect the developer image on the surface of the intermediate transfer body by a detecting part provided between the first transfer position and the second transfer position;

an estimating part configured to determine a distance from the first transfer position to a detecting position by the detecting part based on a time period from a time when the developer image undergoes the primary transfer to a time when detection is made by the detecting part;

the estimating part configured to estimate a moving distance necessary for moving the developer image having undergone the primary transfer onto the intermediate transfer body from the detecting position to the second transfer position based on a difference between the distance and a preset standard distance; and an adjusting part configured to adjust a time for conveying the transfer member to the second transfer position based on the moving distance.

Other objects, features, and advantages of the present invention will become more apparent from the following detailed description when read in conjunction with the accompanying drawings.

DETAILED DESCRIPTION OF THE PREFERRED EMBODIMENTS

A description is given below, with reference to the FIG. 1 through FIG. 9 of embodiments of the present invention.

In the following explanation, an example where the present invention is applied to a tandem type color laser beam printer as an image forming apparatus is discussed. However, the image forming apparatus where the present invention may be applied is not limited to the color laser beam printer but the present invention may be applied to any image forming apparatus such as a color copier or facsimile machine where an electrophotographic method is applied.

Figure 1:
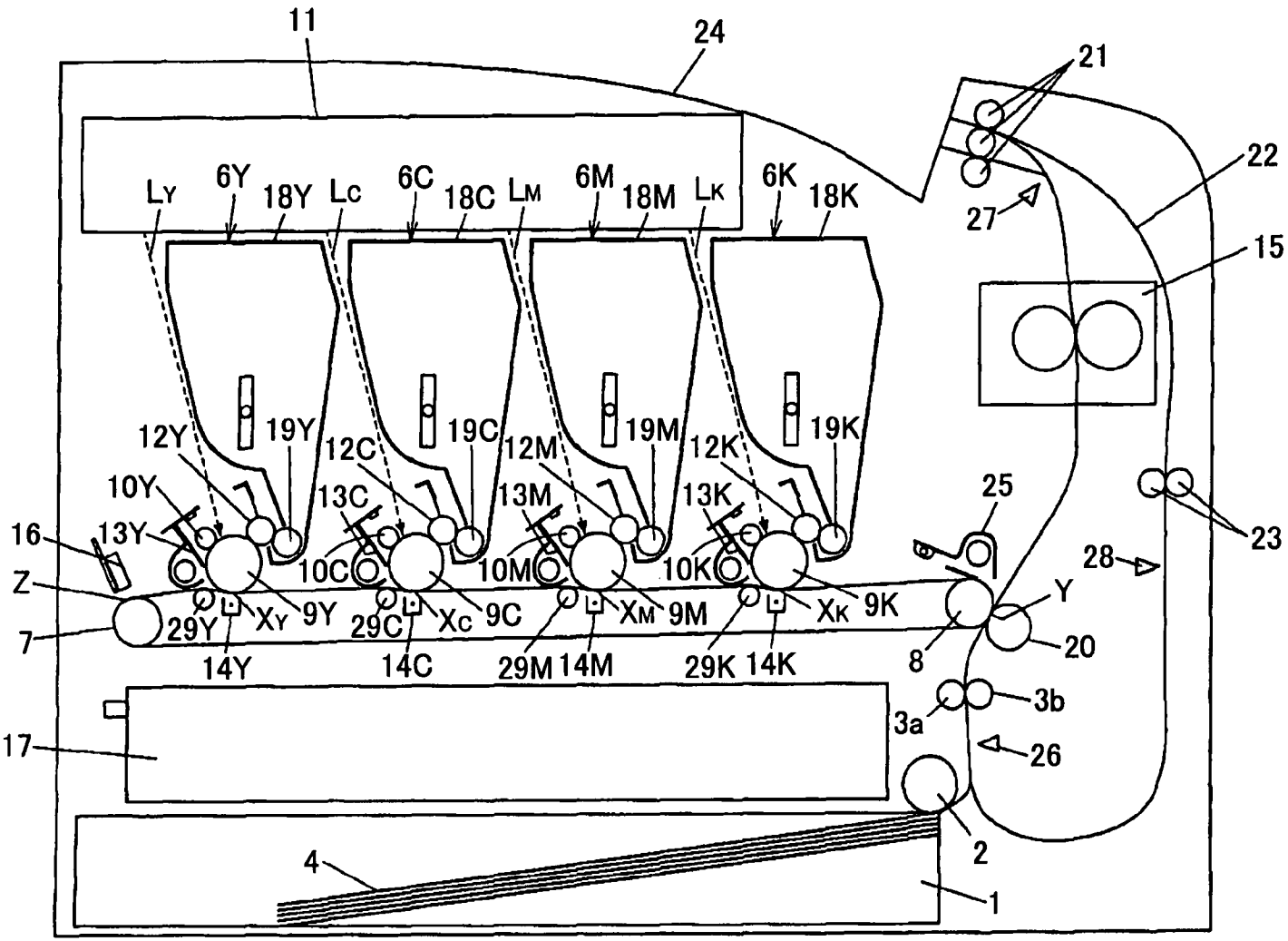
FIG. 1 is a schematic structural view of an image forming apparatus of an embodiment of the present invention.

FIG. 1 is a schematic structural view of an image forming apparatus of an embodiment of the present invention.

In this image forming apparatus, four image process parts 6K, 6M, 6C, and 6Y configured to form toner images of four colors (K: black, M: magenta, C: cyan, and Y: yellow) are arranged in a line along an endless intermediate transfer belt 5 as an intermediate transfer body.

The intermediate transfer belt 5 is rotatably stretched between a driving roller 8 and an idler roller 7. The driving roller 8 is driven by a motor not shown in FIG. 1 so as to be rotated. The intermediate transfer belt 5 is configured to be rotated counterclockwise in FIG. 1 by rotation of the driving roller 8. The idler roller 7 is rotated and driven dependently with the driving roller 8 via the intermediate transfer belt 5.

Under the intermediate transfer belt 5, a waste toner box 17 is placed above a paper feeding tray 1 where transfer papers 4 are received. A transfer paper 4 situated at the top position among the transfer papers 4 received in the paper feeding tray 1 is fed by a paper feeding roller 2 at the time of image forming in order to be conveyed to a second transfer position Y by making time adjustments using a pair of resist rollers 3*a* and 3*b* as discussed below.

The image process parts 6K, 6M, 6C, and 6Y have common structures except for use of toners of colors different from each other. For example, the image process part 6K configured to generate the toner image of black color includes a cylindrical shaped photosensitive body 9K as an image carrier, an electrifier 10K, a developing device 12K, a photosensitive body cleaner 13K, a toner container 18K, and other parts which are situated around the photosensitive body 9K.

An exposing device 11 is provided above the image process parts 6K, 6M, 6C, and 6Y. The exposing device 11 includes four laser light sources (not shown in FIG. 1) corresponding to the image process parts 6K, 6M, 6C, and 6Y. Laser lights $L_K$, $L_M$, $L_C$, and $L_Y$ emanating from the light sources are reflected by a rotating polygon mirror (not shown in FIG. 1) so as to be concentrated by a fθ lens (not shown in FIG. 1). As a result of this, surfaces of the photosensitive bodies 9K, 9M, 9C, and 9Y are exposed.

In addition, in the exposing device 11, the polygon mirror is rotated so that the laser lights $L_K$, $L_M$, $L_C$, and $L_Y$ move in axial directions of the photosensitive bodies 9K, 9M, 9C, and 9Y so that main scanning is performed. The photosensitive bodies 9K, 9M, 9C, and 9Y are rotated so that sub-scanning in the circumferential directions of the photosensitive bodies 9K, 9M, 9C, and 9Y (conveying direction of the transferring paper 4) is performed.

The photosensitive body 9K is formed by covering a cylindrical shaped aluminum drum surface with an organic semiconductor as a photoconductive material. The configuration of the photosensitive body 9K may be not cylindrical but belt shaped. The electrifier 10K is driven by a driving part (not shown in FIG. 1) so as to evenly charge the surface of the photosensitive body 9K rotating clockwise in FIG. 1.

The surface of the photosensitive body 9K being evenly charged is scanned by the laser light $L_k$ irradiated from the exposing device 11, so that an electrostatic latent image for black color is carried (formed) on the surface of the photosensitive body 9K. The electrostatic latent image for black color is developed by the developing device 12K using a black color toner to form a black color toner image.

The toner is received in the container 18 which also functions as a housing of the image process part 6K. The toner is supplied to the developing device 12K by a supplying roller 19K rotatably provided at the lower end part of the container 18K. If the remaining amount of the toner in the container 18K becomes less than a predetermined amount, the entire image process part 6K is exchanged instead of resupplying the toner in the container 18K.

The toner image carried on the surface of the photosensitive body 9K undergoes primary transfer to the surface of the intermediate transfer belt 5 in a first transfer position $X_K$. The toner remaining on the surface of the photosensitive body 9K after primary transfer is removed for the next image forming by a photosensitive body cleaner 13K and any residual electric charge is statically eliminated.

The toner removed by the photosensitive body cleaner 13K is received by the waste toner box 17 via a conveying path not shown in FIG. 1. Furthermore, the developer may be a bi-component developer containing the toner and a magnetic carrier or may be only a toner powder.

In forming the color image, a color conversion process is applied by a control part 40 to a color separation image signal provided in advance from a color image reading device, a printer driver of a personal computer, or the like, based on a strength level of the color separation image. As a result of this, the color separation image signal is converted to color image data of black (K), magenta (M), yellow (Y), and cyan (C) so as to be output to the exposing device 11.

When the image forming starts the surfaces of the photosensitive bodies 9K, 9M, 9C, and 9Y are evenly charged by the electrifiers 10K, 10M, 10C, and 10Y. Then, under the control of the control part 40, scanning of the laser lights $L_K$, $L_M$, $L_C$, and $L_Y$ is performed by the exposing device 11, so that electrostatic latent images are carried on the surfaces of the photosensitive bodies 9K, 9M, 9C, and 9Y. The latent images carried on the surfaces of the photosensitive bodies 9K, 9M, 9C, and 9Y are developed by the developing devices 12K, 12M, 12C, and 12Y, respectively, so that the toner images of single colors are formed.

In the first transfer positions $X_K$, $X_M$, $X_C$, and $X_Y$ where the photosensitive bodies 9K, 9M, 9C, and 9Y and primary transferring devices 14K, 14M, 14C, and 14Y, respectively, face each other, these toner images are overlapped on the surface of the intermediate transfer belt 5 so as to be transferred. This toner image (full color toner image formed by stacking four single color toner images) is conveyed by the intermediate transfer belt 5 so as to undergo secondary transfer to the surface of the transfer paper 4 by a secondary transferring device 20 in the second transfer position Y facing the secondary transferring device 20.

In addition, after the secondary transfer, the transfer paper 4 is separated from the intermediate transfer belt 5 so as to be sent to a fixing device 15. The color images are fixed to the transfer paper 4 by the fixing device 15. After that, in a case of single surface printing, the transfer paper 4 is discharged to a paper discharging part 24 by a paper discharge roller 21. In a case of two-sided surfaces printing, the rotation of the paper discharge roller 21 is reversed so that the transfer paper 4 is returned to a two-sided surface printing path 22.

On the two-sided surfaces printing path 22, the transfer paper 4 is conveyed by two-sided surfaces rollers 23. As a result of this, in the second transfer position Y, another toner image undergoes secondary transfer, by the secondary transferring device 20, on a second surface, which is a surface opposite to a surface (first surface) where the full color toner image is formed/printed first, of the transfer paper 4 conveyed to the second transfer position Y by the resist rollers 3*a* and 3*b*.

The transfer paper 4 after the secondary transfer is again separated from the intermediate transfer belt 5. After the color images are fixed on the transfer paper 4 by the fixing device 15, the transfer paper 4 is discharged to the paper discharge part 24.

In addition, after the toner images undergo secondary transfer to the transfer paper 4, the residual toner situated on the surface of the intermediate transfer belt 5 is removed by an intermediate transfer belt cleaner 25 for preparing for the next image forming. The toner removed by the intermediate transfer belt cleaner 25 is also received by the waste toner box 17 via a conveyance path not shown in FIG. 1.

A resist sensor 26, a paper discharge sensor 27, and a two-sided surfaces sensor 28 configured to detect the passing of the transfer paper 4 are provided at a conveyance path between the paper feeding roller 2 and the resist rollers 3*a* and 3*b*, a conveyance path 27 between the fixing device 15 and the paper discharge roller 21, and the two-sided surfaces printing path 22 between the two-sided surfaces rollers 23 and the resist rollers 3*a* and 3*b*. A detection signal of each sensor is sent to the control part 40.

Figure 2:
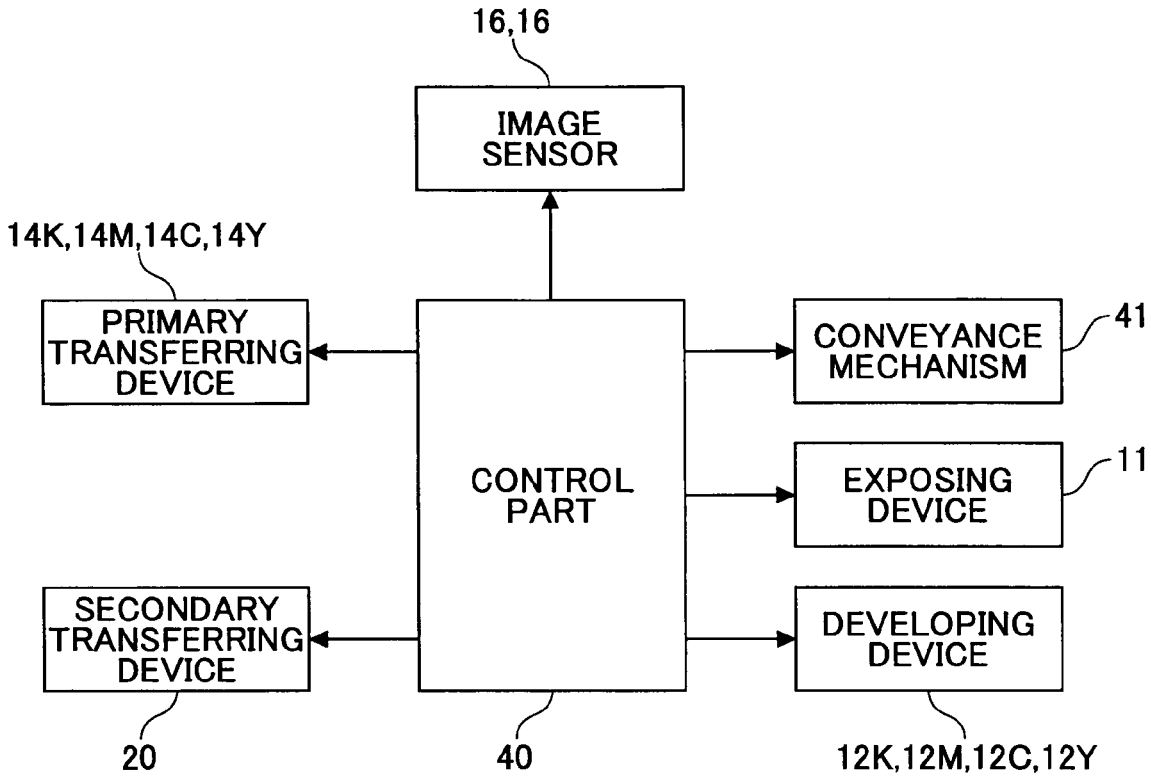
FIG. 2 is a block diagram of the image forming apparatus of an embodiment of the present invention.

The image forming device of this embodiment includes, as shown in FIG. 2, the control part 40, a conveyance mechanism 41, and image sensors 16, 16. Here, FIG. 2 is a block diagram of the image forming apparatus of the embodiment of the present invention.

The control part 40 includes a CPU, a ROM, a RAM, an EEPROM, and other parts. By implementing a program stored in the ROM, the control part 40 controls the entire apparatus so that the above-mentioned image forming (printing) process is applied.

The conveyance mechanism 41 includes motors, an electromagnetic clutch, and other parts. The motors rotate the paper feeding roller 2, the resist rollers 3*a* and 3*b*, the paper discharge rollers 21, and the two-sided surfaces rollers 23. The electromagnetic clutch turns on or off transfer of electric power from the motor to each roller.

The control part 40 turns on or off the driving of the motor and controls turning on or off the electromagnetic clutch, so that the transfer paper 4 is transferred from the paper feeding tray 1 to the paper discharge part 24 via (i) the second transfer position Y, the fixing device 15, and the paper discharge rollers 21, or (ii) the second transfer position Y, the fixing device 15, the paper discharge rollers 21, the two-sided surface printing path 22, the second transferring position Y, the fixing device 15, and the paper discharge rollers 21.

In the meantime, positioning for stacking the toner images on the surface of the intermediate transfer belt 5 is performed by setting the exposure starting time of each color of the exposing device 11 by the control part 40, so that timings when the intermediate transfer belt 5 is conveyed to the first transfer positions $X_K$, $X_M$, $X_C$, and $X_Y$ and the timings when the toner images are developed on the surfaces of the photosensitive bodies 9K, 9M, 9C, and 9Y and move to the first transfer positions $X_K$, $X_M$, $X_C$, and $X_Y$, respectively, are matched with each other.

However, due to an error of axial positioning of four photosensitive bodies 9K, 9M, 9C, and 9Y, an error of parallel positioning of the photosensitive bodies 9K, 9M, 9C, and 9Y, an error of positioning of an optical system, a timing error of writing, and other errors, the single color toner images are not overlapped in a position where they should be overlapped. As a result of this, an image where positions of the single color toner images are shifted may be formed.

Even if adjustment is made in an initial stage, these errors may happen in a case of exchange of the image process part 6, maintenance, conveying of the product, and other processes. In addition, the errors may change with time due to temperature expansion of the mechanism after the image forming is performed for multiple transfer papers. Accordingly, it is necessary to make adjustment with a short time range.

It is known that there are five kinds of position shifts (color drifts/shifts) generated among the toner images due to the above-mentioned errors. See, for example, Japanese Laid-Open Patent Application Publication No. 11-65208 and Japanese Laid-Open Patent Application Publication No. 2002-244393. These position shifts are:

Skew

Shift in a sub-scanning direction of resist rollers

Unevenness in a sub-scanning direction of pitch

Shift in a main scanning direction of resist rollers

Error in a main scanning direction of magnification

Figure 3:
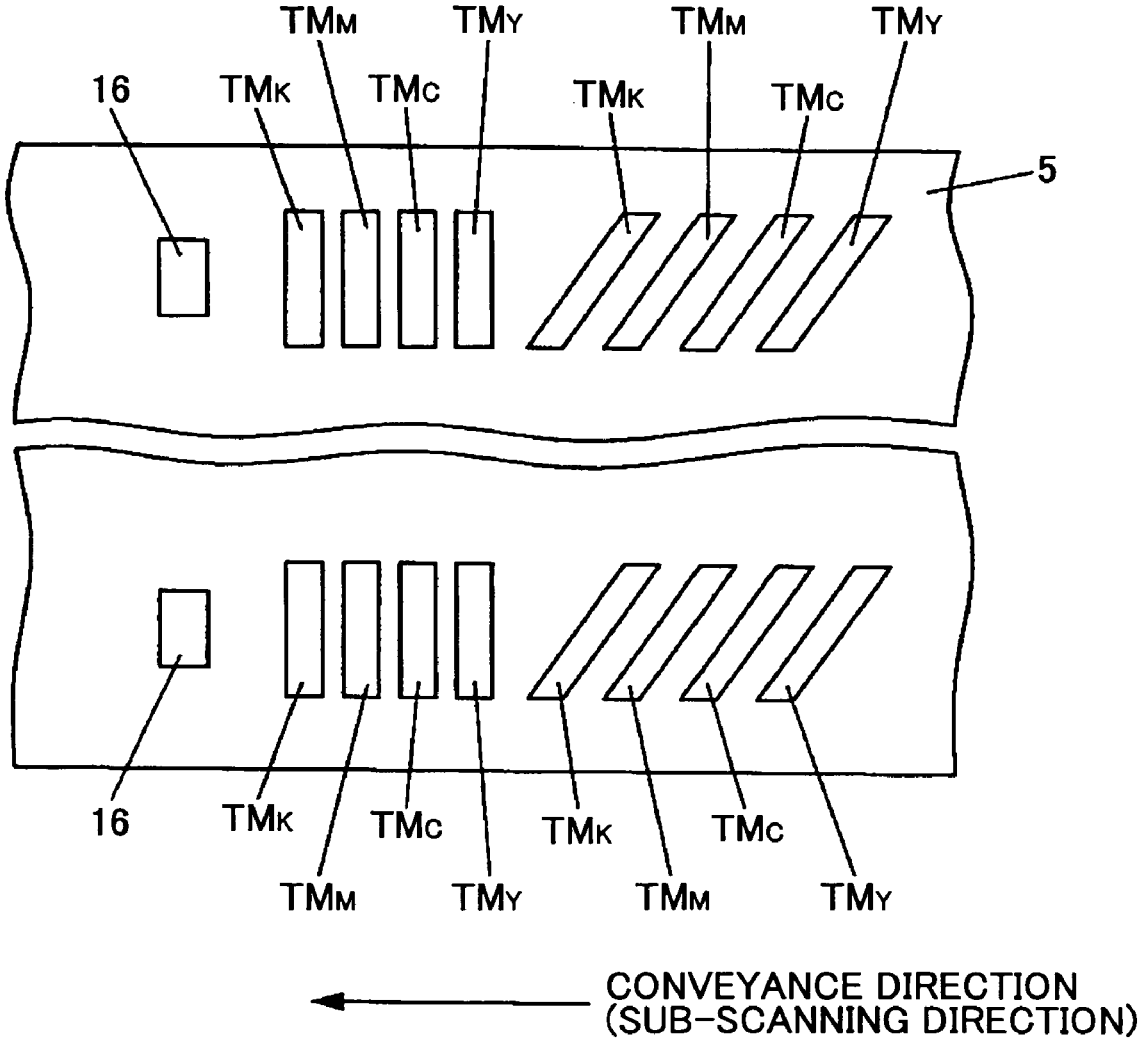
FIG. 3 is a view for explaining correction of toner images.

Accordingly, in the image forming apparatus of the embodiment of the present invention as well as the techniques discussed in the above-mentioned documents, correction of position shift is made before the full color toner image is actually formed on the transfer paper 4. In other words, the position shift (color shift/drift) is corrected by forming a pattern made of correction toner images $TMn_K$, $TMn_M$, $TMn_C$, and $TMn_Y$ (n=1, 2) shown in FIG. 3 on the surface of the intermediate transfer belt 5, detecting the correction toner images $TMn_K$, $TMn_M$, $TMn_C$, and $TMn_Y$ of the pattern by optical image sensors as detecting parts, calculating by the control part 40 the amount of position shift generated among the toner images based on the result of detection by the image sensors 16, 16, and changing settings of the exposure starting time at the exposing device 11 and others. Here, FIG. 3 is a view for explaining correction toner images.

The image sensors 16, 16 include a light emitting element made of a light emitting diode, a light receiving element made of a photo diode, a circuit configured to amplify and shape the waveform of an output of the light receiving element, and other parts which are not shown in FIG. 2.

The light emanating from the light emitting element where light emitting is controlled by the control part 40 is reflected by the surface of the intermediate transfer belt 5 or the correction toner images $TMn_K$, $TMn_M$, $TMn_C$, and $TMn_Y$ and received by the light receiving element. A detection signal having a level corresponding to the intensity (light amount) of the reflected light is input to the control part 40.

In other words, since the reflectivity of the toner is lower than the reflectivity of the surface of the intermediate transfer belt 5, the amount of light received by the light receiving element is reduced compared to the light reflected by the correction toner images $TMn_K$, $TMn_M$, $TMn_C$, and $TMn_Y$, so that the correction toner images $TMn_K$, $TMn_M$, $TMn_C$, and $TMn_Y$ can be detected when passing through the detecting position Z.

The control part 40 calculates the amounts of five kinds of position shifts based on (i) relative time difference between a detected position (timing) of a black correction toner image $TMn_K$ and other detected positions (timings) of magenta, cyan, and yellow correction toner images $TMn_M$, $TMn_C$, and $TMn_Y$ detected by the image sensors 16, 16, and (ii) the setting of the rotational speed of the intermediate transfer belt 5. The control part 40 also performs the following correction in order to eliminate the calculated amount of position shift. See Japanese Laid-Open Patent Application Publication No. 2002-244393.

It should be noted that since the method for calculating the amount of position shift is known as discussed in Japanese Laid-Open Patent Application Publication No. 11-65208, detailed explanations of the method are omitted here.

Correction of the skew shift is made in the exposing device 11 by changing the inclination of a mirror (not shown) for irradiating a laser light concentrated by a fθ lens onto the surfaces of the photosensitive bodies 9K, 9M, 9C, and 9Y. The change of inclination of the mirror can be performed by driving a mechanism part where the inclination angle of the mirror can be adjusted by a stepping motor.

In addition, correction of shifts in a sub-scanning direction and a main scanning direction of the resist rollers and unevenness in a sub-scanning direction of pitch can be performed by instructions from the control part 40 so that writing timing for emitting the laser light from the laser light source is moved forward or delayed based on each amount of the position shift.

Furthermore, an error in a main scanning direction of magnification can be performed by instructions from the control part 40 so that a clock signal output from a clock generator in the expositing device 11 is adjusted based on the amount of the shift of the magnification error.

Next, details of the present invention are discussed.

As discussed above, the intermediate transfer belt 5 made of synthetic resin material is stretched between a driving roller 8 and an idler roller 7 with tension. Accordingly, the intermediate transfer belt 5 may be extended or contracted by changes of the peripheral temperature, or by a change with time so that the perimeter length of the intermediate transfer belt 5 may be changed.

In addition, in a case where the intermediate transfer belt 5 is extended or contracted, the moving distance where the full color toner image having undergone primary transfer onto the surface of the intermediate transfer belt 5 is conveyed to the second transfer position Y, that is the distance along the surface of the intermediate transfer belt 5 from the first transfer positions $X_K$, $X_M$, $X_C$, and $X_Y$ to the second transfer position Y, is also changed. If the timing for conveying the transfer paper 4 to the second transfer position Y is set without considering such a distance change (perimeter length change of the intermediate transfer belt 5), the relative position when the toner image undergoes secondary transfer to the transfer paper 4 may be shifted.

Accordingly, in this embodiment, the image sensor 16 configured to detect the toner image is provided between the first transfer position $X_Y$ where the toner image undergoes primary transfer from the photosensitive body 9Y situated in a top upstream position onto the intermediate transfer belt 5, and the second transfer position Y where the toner image undergoes secondary transfer from the intermediate transfer belt 5 to the transfer paper 4.

A time period from the time when the toner image (for example, the correction toner images $TMn_K$) undergoes primary transfer to the time when the toner image is detected by the image sensor 16 multiplied by the speed of the intermediate transfer belt 5 equals the distance L1' from the first transfer position $X_K$ to the detection position Z of the image sensor 16.

Based on the difference between the distance L1' and a preset standard distance L1, a moving distance L2' necessary for moving the toner image having undergone primary transfer onto the intermediate transfer belt 5 from the detection position Z to the second transfer position Y is estimated by the control part 40 as an estimating part.

The timing for conveying the transfer paper 4 to the second transfer position Y based on the moving distance L2' is adjusted by the control part 40 as an adjusting part.

Figure 4:
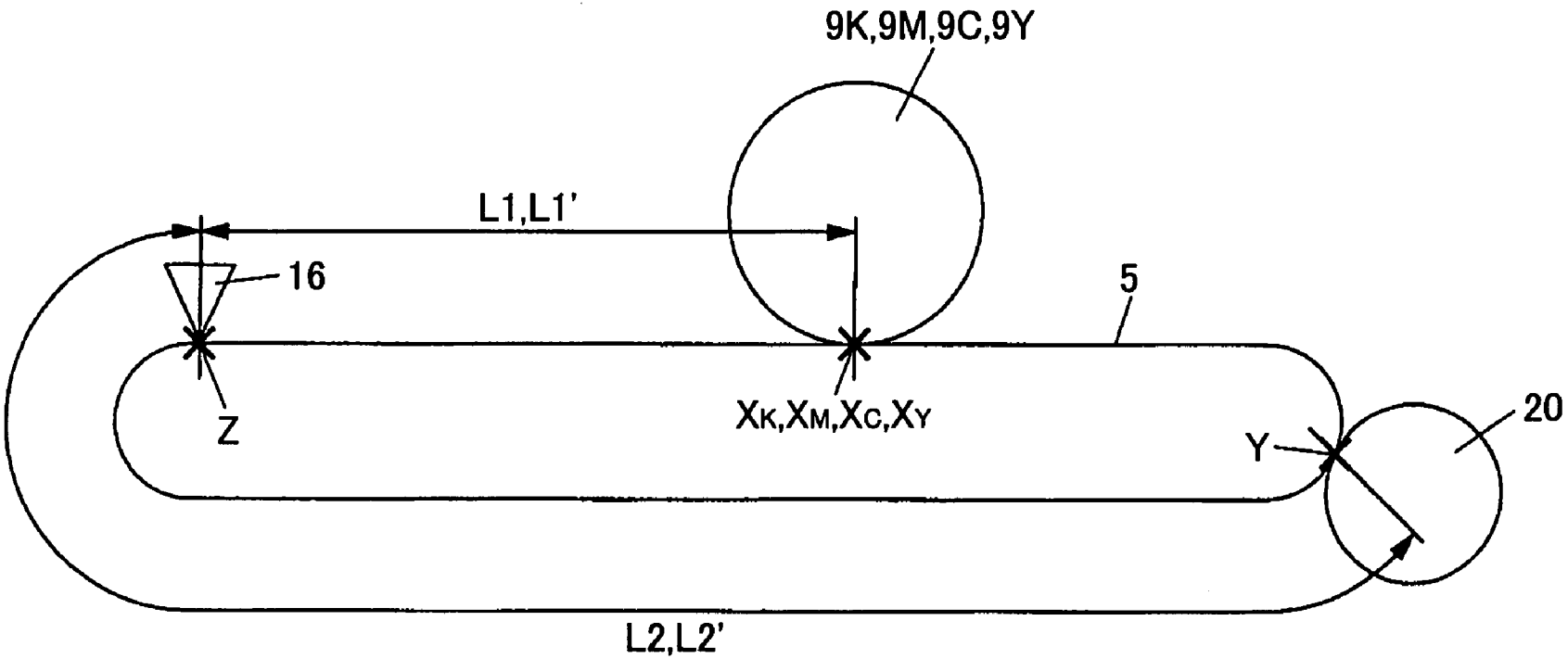
FIG. 4 is a view for explaining a calculation method of moving distance.

For example, as shown in FIG. 4, if an ideal moving distance from the first transferring position $X_K$ to the detection position Z is defined as "L1", the perimeter length change rate of the intermediate transfer belt 5 can be determined by the following equation 1. Here, FIG. 4 is a view for explaining a calculation method of moving distance.

$$(L1'-L1)/L1 \qquad \text{(equation 1)}$$

Here, when the intermediate transfer belt 5 made of an endless flexible member is expanded and contracted due to change of the periphery temperature change with the change of time, the intermediate transfer belt 5 is expanded and contracted not partially but entirely and evenly. Accordingly, in a case where the standard distance namely an ideal moving distance, from the detection position Z to the second transfer position Y is defined as "L2", an actual moving distance L2' from the detection position Z to the second transfer position Y is calculated by the following equation 2.

$$L2'=(L1'-L1)/L1\times L2+L2 \quad \text{(equation 2)}$$

Based on the actual moving distance L2', the control part 40 controls the conveyance mechanism 41 and adjusts the timing for conveying the transfer paper 4 to the second transfer position Y, so that the position shift of the toner image which is to undergo secondary transfer to the transfer paper 4 is prevented.

In addition, in the technique discussed at Japanese Laid-Open Patent Application Publication No. 2001-215857, the toner image transferred on the surface of the intermediate transfer belt is detected twice by the sensor. Therefore, it is necessary to rotate the intermediate transfer belt at least one full rotation. Hence, during a time period while the intermediate transfer belt is being rotated at one full rotation, image forming cannot be performed. Therefore, the elapsed time for image forming becomes long so that the productivity is degraded.

In addition, normally, it is necessary to remove the toner remaining on the surface of the intermediate transfer belt after the secondary transfer, before the toner remaining on the surface of the intermediate transfer belt reaches the first transfer position. However, if the intermediate transfer belt is rotated one full rotation while the toner image remains on the surface of the intermediate transfer belt, it is necessary to provide a mechanism for switching between a case where the residual toner is removed and a case where the residual toner is not removed so that an increase of cost or making the size in the apparatus large may be required.

On the other hand, in the image forming apparatus of the embodiment of the present invention, detection of the toner image by the image sensors 16, 16 is required only one time. Therefore, there is no need to rotate the intermediate transfer belt one full rotation to detect the perimeter length of the intermediate transfer belt. Hence, an increase of cost or making the size in the apparatus large is prevented.

Figure 5:
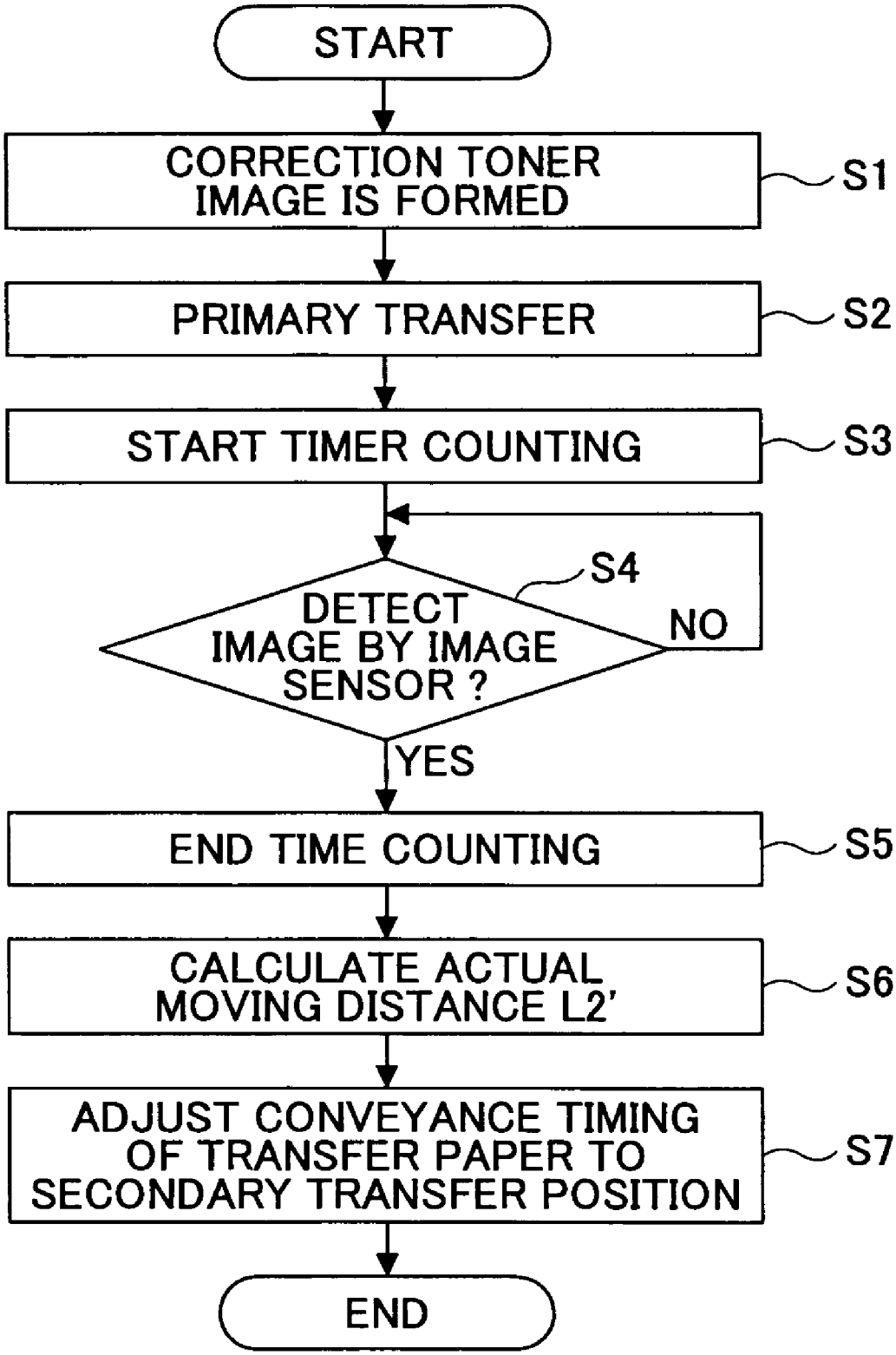
FIG. 5 is a first flowchart for explaining operations of position shift adjustment.

The position adjustment of the secondary transfer by the control part 40 is discussed with reference to a flowchart shown in FIG. 5. FIG. 5 is a first flowchart for explaining operations of position shift adjustment.

The control part 40 to which the electric power is supplied starts working and controls the exposing device 11 and the image process parts 6K, 6M, 6C, and 6Y. As a result of this, patterns of position correction toner images $TM_K$, $TM_Y$, $TM_C$, and $TM_Y$ are formed on the surfaces of the photosensitive bodies 9K, 9M, 9C, and 9Y in step S1, primary transfer is made at the first transfer positions $X_K$, $X_Y$, $X_C$, and $X_Y$ in step S2, and a passing time from the first transfer of the black correction toner image $TM_K$ is counted by a timer in step S3.

If the image sensors 16, 16 detect the black correction toner image $TM_K$ (YES in step S4) and its detection signal is input to the control part 40, the control part 40 ends timer counting in step S5, calculates the actual moving distance L2' in step S6, and sets a starting time of the resist rollers 3*a* and 3*b* based on the calculated moving distance L2'. As a result of this, the timing for conveying the transfer paper 4 to the second transfer position Y is adjusted in step S7.

As the distance L1' from the actually measured first transfer position X to the detection position Z of the image sensor 16 increase, the precision of the calculated moving distance L2' becomes higher. Accordingly, in this embodiment, the distance from the first transfer position $X_K$ to the detection position Z is measured for block color situated farthest from the image sensors 16, 16. The distance from the first transfer position $X_M$, $X_C$, or $X_Y$, for another color, to the detection position Z may be measured.

Furthermore, in this embodiment, the distance L1' from the first transfer position X to the detection position Z of the image sensor 16 is measured by detecting the black correction toner image $TM_K$ by the image sensor 16. For example, in a case where the distance L1' is measured by separately forming the image other than the correction toner image TM, time for processes for color correction and position shift adjustment becomes long so that start of image forming is delayed. However, by using the correction toner image Tm for measuring the distance L1' for position adjustment like this embodiment, it is possible to start image forming quickly.

In the image forming apparatus of this embodiment, four color toners for forming/printing a full color image are not always used. For example, in a case where a document of only characters is printed, only black color toner is used. By moving the first transfer rollers $\mathbf{29}_M$, $\mathbf{29}_C$, and $\mathbf{29}_Y$ situated at an upstream side of the first transfer positions $X_M$, $X_C$, and $X_Y$, the intermediate transfer belt 5 is separated from the photosensitive bodies 9M, 9C, and 9Y for magenta, cyan, and yellow.

In other words, the intermediate transfer belt 5 is made to contact the photosensitive bodies 9K, 9M, 9C, and 9Y by the primary transfer roller $\mathbf{29}_K$, $\mathbf{29}_M$, $\mathbf{29}_C$, and $\mathbf{29}_Y$. As the number of the photosensitive bodies 9M, 9C, and 9Y where the primary transfer roller $\mathbf{29}_M$, $\mathbf{29}_C$, and $\mathbf{29}_Y$ move and come in contact is decreased, the distance L1' from the first transfer position $X_K$ to the detection position Z is changed.

Figure 6:
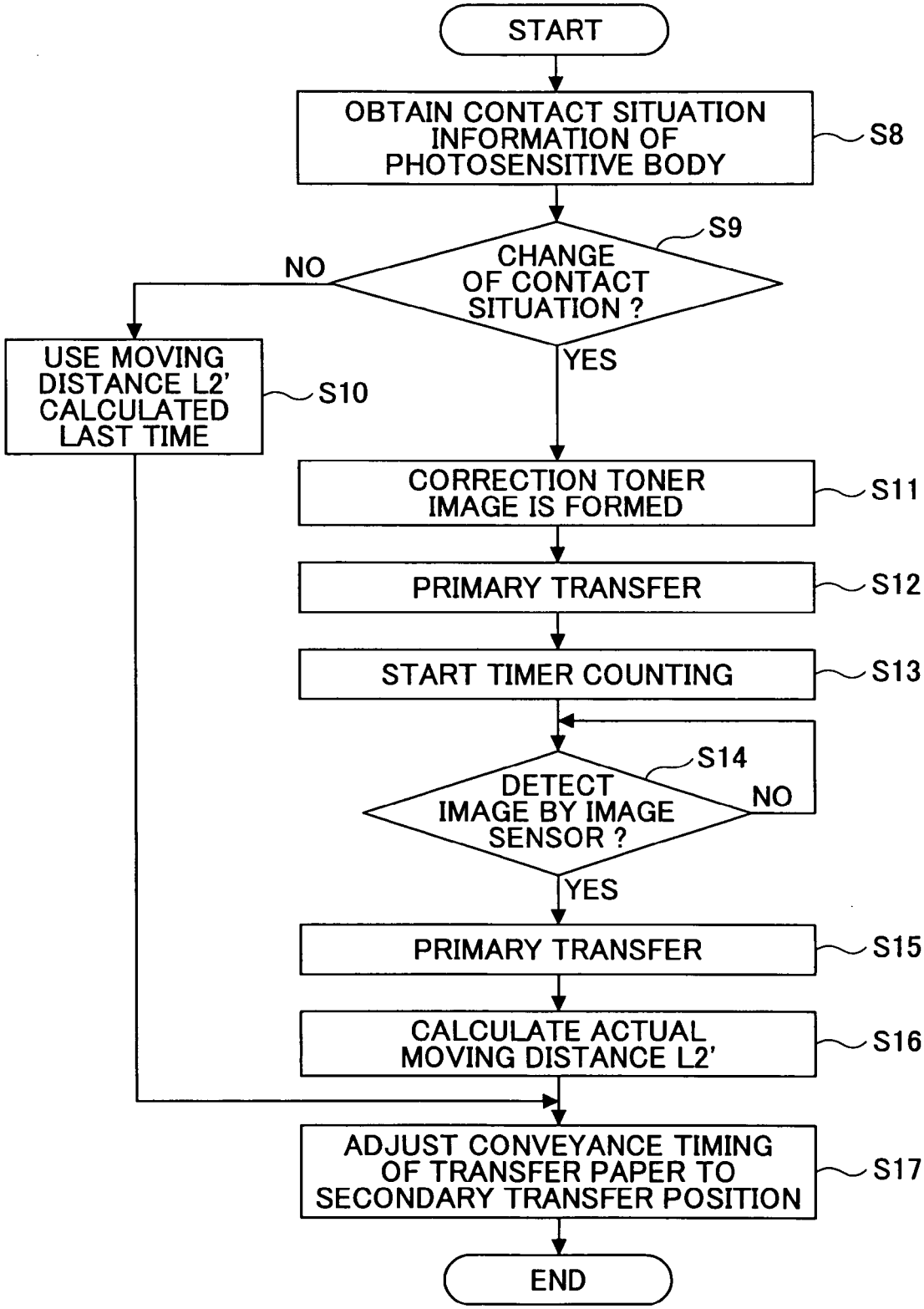
FIG. 6 is a second flowchart for explaining the operations of the position shift adjustment.

Accordingly, as shown in a flowchart of FIG. 6, the control part 60 obtains information with respect to contact of the photosensitive bodies 9K, 9M, 9C, and 9Y with the intermediate transfer belt 5 such as information of existence of color image data in step S8.

If there is no change from the contact situation when the moving distance L2' is calculated (NO in step S9), by using the moving distance L2' calculated last time and setting the starting time of the resist rollers 3*a* and 3*b*, the timing for conveying the transfer paper 4 to the second transfer position Y is adjusted in step S17.

In addition, if there is a change from the contact situation when the moving distance L2' is calculated (YES in step S9), the control part 40 newly calculates the moving distance L2' based on steps s11 through s16 that are the same as steps S1 through s7 and sets the starting time of the resist rollers 3*a* and 3*b* based on the moving distance L2', and thereby the timing for conveying the transfer paper 4 to the second transfer position Y is adjusted.

Thus, by performing the position shift adjustment based on the change of the contact situation of the photosensitive bodies 9K, 9M, 9C, and 9Y to the intermediate transfer belt 5, it is possible to prevent the position shift of the toner image based on the change of the number and the existence of the photosensitive bodies 9K, 9M, 9C, and 9Y which come in contact with the surface of the intermediate transfer belt 5.

In addition, expansion and contraction of the intermediate transfer belt 5 may be generated due to the change of the temperature. Accordingly, a temperature sensor (for example, an element such as a thermistor where a resistance value is changed based on temperature change) configured to detect the periphery temperature of the intermediate transfer belt may be provided so that the position shift may be adjusted based on the periphery temperature detected by the temperature sensor.

Figure 7:
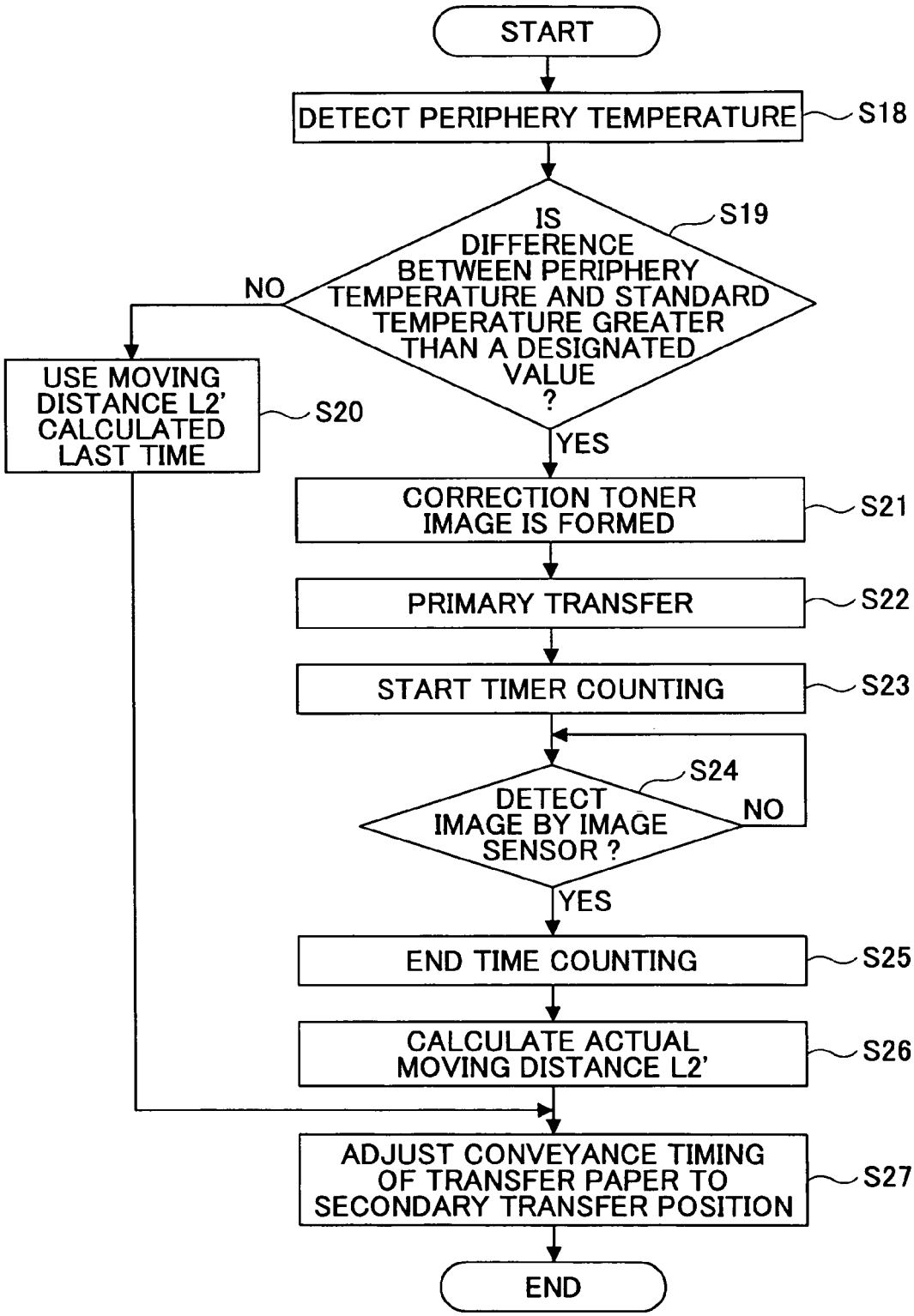
FIG. 7 is a third flowchart for explaining the operations of the position shift adjustment.

Therefore, as shown in a flowchart of FIG. 7, the control part 40 obtains information of the periphery temperature detected by the temperature sensor in step S18.

If the difference between an actual periphery temperature and a standard temperature which is a periphery temperature when the moving distance L2' is calculated last time is less than the designated value (No in step S19), it is regarded that there is no perimeter length change of the intermediate transfer belt 5 so that the moving distance L2' calculated last time is used in step S20 and the starting time of the resist rollers 3*a* and 3*b* are set. As a result of this, the timing for conveying the transfer paper 4 to the second transfer position Y is adjusted in step S27.

If the difference between an actual periphery temperature and a standard temperature which is a periphery temperature when the moving distance L2' is calculated last time is equal to or greater than the designated value (YES in step S19), it is regarded that there is perimeter length change of the intermediate transfer belt 5 so that the control part 40 newly calculates the moving distance L2' based on steps S21 through S27 that are the same as steps s1 through S7 and sets the starting time of the resist rollers 3*a* and 3*b* based on the moving distance L2', and thereby the timing for conveying the transfer paper 4 to the second transfer position Y is adjusted.

Thus, by performing the position shift adjustment based on the change of the periphery temperature of the intermediate transfer belt 5, it is possible to prevent the position shift of the toner image based on expansion and contraction of the intermediate transfer belt 5 due to the change of the periphery temperature.

In a case where the density of the correction toner image TM is low so that the detection is not done well by the image sensors 16, 16, an error in the calculated moving distance L2' becomes large. As a result of this, if the position shift is adjusted based on the moving distance L2', the position shift may be increased.

Figure 8:
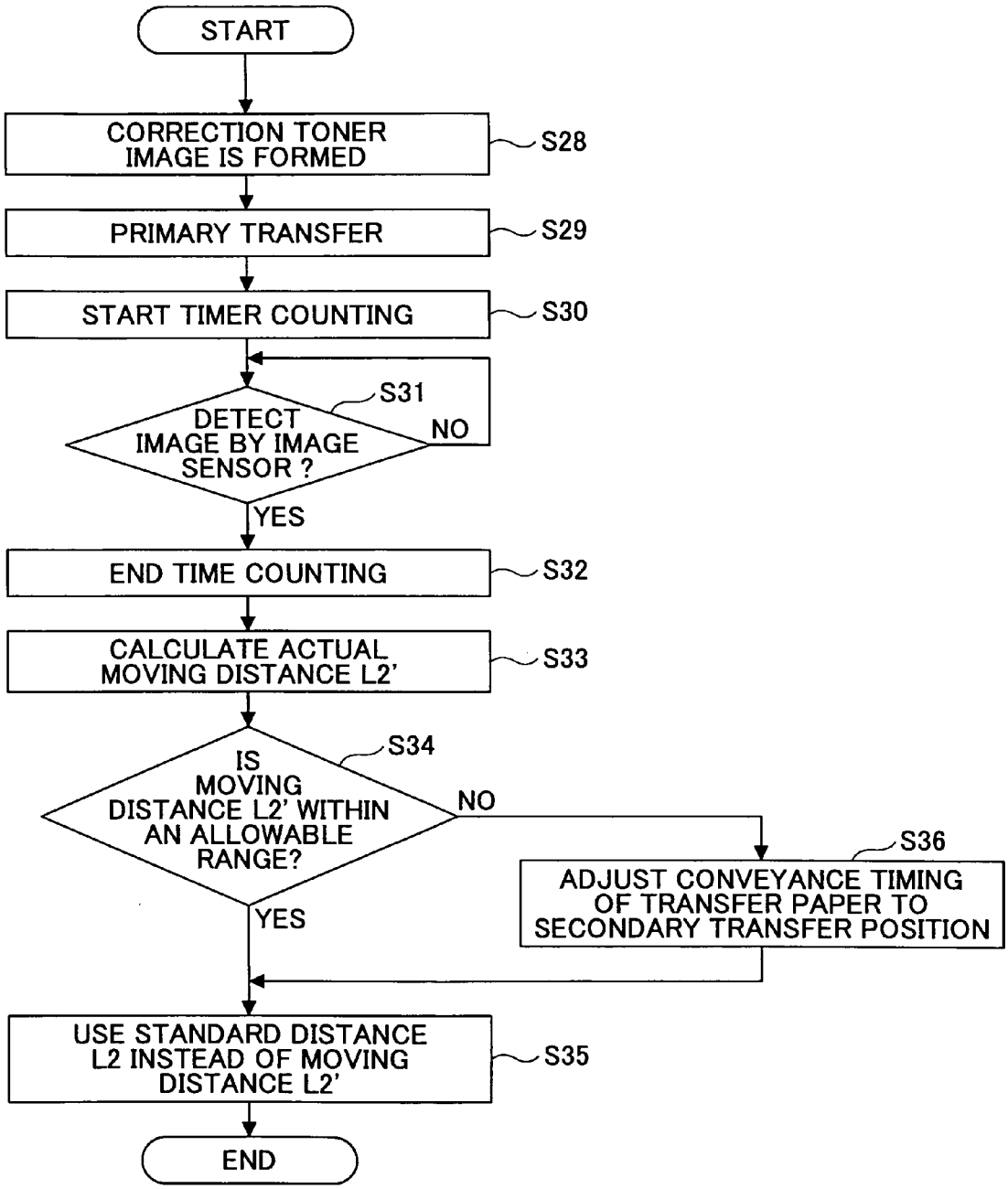
FIG. 8 is a fourth flowchart for the explaining operations of the position shift adjustment.

Accordingly, as shown in a flowchart of FIG. 8, after steps S28 through S33 that are the same as steps s1 through s6 are performed, the control part 40 determines whether the calculated moving distance L2' is within a designated allowable range in step S34.

If the calculated moving distance L2' is within a designated allowable range (YES in step S34), the control part 40 newly sets the starting time of the resist rollers 3*a* and 3*b* based on the moving distance L2' and thereby the timing for conveying the transfer paper 4 to the second transfer position Y is adjusted in step S35.

If the calculated moving distance L2' is not within a designated allowable range (NO in step S34), the control part 40 newly sets the starting time of the resist rollers 3*a* and 3*b* based on the standard distance L2 in step S36 and thereby the timing for conveying the transfer paper 4 to the second transfer position Y is adjusted in step S35.

Thus, in a case where the moving distance L2' is out of the designated allowable range, the time for conveying the transfer paper 4 to the second transfer position Y is set by changing the moving distance L2' to the designated standard distance L2. Therefore, even if the toner image cannot be detected due to some reason, it is possible to prevent the position shift of the toner image from being large.

If the reason why the toner image cannot be detected is that the density of the correction toner image TM is low, the toner image can be detected by heightening the density of the correction toner image TM so that the calculated moving distance L2' is within the allowable range.

Figure 9:
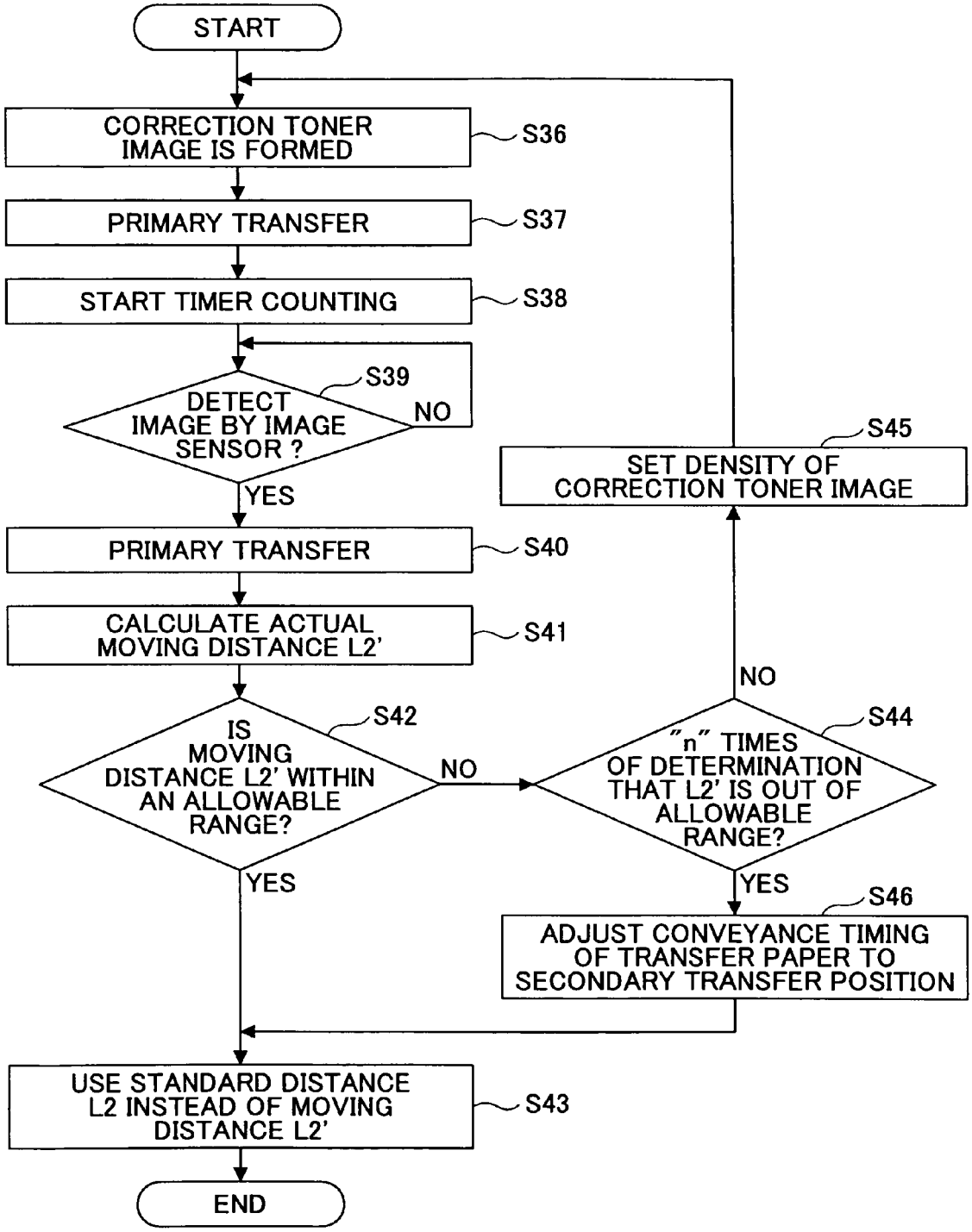
FIG. 9 is a fifth flowchart for explaining the operations of the position shift adjustment.

Accordingly, as shown in a flowchart of FIG. 9, after steps s36 through s41 that are the same as steps s1 through s5 are performed, the control part 40 determines whether the calculated moving distance L2' is within a designated allowable range in step S42.

If the calculated moving distance L2' is within a designated allowable range (YES in step S42), the control part 40 newly sets the starting time of the resist rollers 3*a* and 3*b* based on the moving distance L2' and thereby the timing for conveying the transfer paper 4 to the second transfer position Y is adjusted in step S43.

In a case where the calculated moving distance L2' is not within a designated allowable range (NO in step S42), if the number where the control part 40 determines the calculated moving distance L2' being out of a designated allowable range is not "n" (n≧2) (NO in step S44), the density of the correction toner image TM is set high in step S45 and the moving distance L2' is calculated again.

If the number where the control part 40 determines the calculated moving distance L2' being out of a designated allowable range reaches "n" (n≧2) (Yes in step S44), the control part 40 newly sets the starting time of the resist rollers 3*a* and 3*b* based on the standard distance L2 in step S46 and thereby the timing for conveying the transfer paper 4 to the second transfer position Y is adjusted in step S43.

In order to increase the density of the correction toner image TM, the control part 40 as a density adjusting part may adjust a developing bias which is a voltage to the developing device 12K, 12M, 12C, and 12Y at the time of developing, so that the amount of toner adhered on the surface of the photosensitive bodies 9K, 9M, 9C, and 9Y is increased.

Thus, in a case where the moving distance L2' is out of the designated allowable range, by increasing the density of the toner image undergoing primary transfer on the surface of the intermediate transfer belt 5, it is possible to detect the toner image when the toner image is not detected due to the low density. As a result of this, it is possible to securely prevent the position shift of the toner image.

In the meantime, the ideal distance L1 and the standard distance L2 used in the equation 1 and the equation 2 by which the moving distance L2' is calculated can be calculated by the setting values. However, the shift from the setting value may be actually made due to unevenness of measurements of components and assemblies.

Accordingly, in a case where it is regarded that the perimeter length of the intermediate transfer belt 5 is not changed such that the image forming apparatus is being used for the first time, by setting the moving distance L2' measured by the control part 40 as a measuring part using the above-discussed steps to equal the standard distance L2, it is possible to reduce influence of an error due to a shift for every device as compared to a case where the standard value L2 is calculated by the setting value.

In addition, when the intermediate transfer belt 5 is exchanged in a case of maintenance, the perimeter length of the intermediate transfer belt 5 may be greatly changed before or after the exchange of the intermediate transfer belt 5. Accordingly, when the intermediate transfer belt 5 is exchanged by setting the moving distance L2' measured by the control part 40 using the above-discussed steps to the standard distance L2, it is possible to reduce the influence of an error due to shift for every intermediate transfer belt 5.

In order to determine whether the intermediate transfer belt is newly exchanged by the control part 40, for example, the operator may operate a switch (not shown) after the exchange and it may be determined that the intermediate transfer belt 5 is exchanged when the operations input of the switch is made to the control part 40.

According to the above-discussed embodiment of the present invention, it is possible to provide an image forming method whereby an intermediate transfer body made of an endless flexible member is rotated, and an image is formed on a surface of a transfer member by undergoing a secondary transfer of a developer image onto a second transfer position from the intermediate transfer body to the transfer member, the developer image undergoing a primary transfer onto a first transfer position from an image carrier to a surface of the intermediate transfer body, the image forming method including:

a step of detecting the developer image on the surface of the intermediate transfer body by a detecting part provided between the first transfer position and the second transfer position;

a step of determining a distance from the first transfer position to a detecting position by the detecting part based on a time period from a time when the developer image undergoes the primary transfer to a time when detection is made by the detecting part;

a step of estimating a moving distance necessary for moving the developer image having undergone the primary transfer onto the intermediate transfer body from the detecting position to the second transfer position based on a difference between the distance and a preset standard distance; and a step of adjusting time for conveying the transfer member to the second transfer position based on the moving distance.

It is also possible to provide an image forming apparatus whereby an intermediate transfer body made of an endless flexible member is rotated, and an image is formed on a surface of a transfer member by undergoing a secondary transfer of a developer image onto a second transfer position from the intermediate transfer body to the transfer member, the developer image undergoing a primary transfer onto a first transfer position from an image carrier to a surface of the intermediate transfer body, the image forming apparatus including:

a detecting part configured to detect the developer image on the surface of the intermediate transfer body by a detecting part provided between the first transfer position and the second transfer position;

an estimating part configured to determine a distance from the first transfer position to a detecting position by the detecting part based on a time period from a time when the developer image undergoes the primary transfer to a time when detection is made by the detecting part;

the estimating part configured to estimate a moving distance necessary for moving the developer image having undergone the primary transfer onto the intermediate transfer body from the detecting position to the second transfer position based on a difference between the distance and a preset standard distance; and an adjusting part configured to adjust a time for conveying the transfer member to the second transfer position based on the moving distance.

According to the above-mentioned image forming method and image forming apparatus, position shift of a developer image undergoing secondary transfer to an image carrying medium can be prevented and increase of cost or making the size of the apparatus large is not caused as compared to the related art where the intermediate transfer body is rotated to detect the perimeter length of the intermediate transfer body.

In the above-mentioned method, a plurality of the image carriers is arranged along a rotational direction of the intermediate transfer body;

the primary transfer is made by overlapping the developer images of different colors from the image carriers onto the surface of the intermediate transfer body;

the developer image which undergoes the primary transfer onto the surface of the intermediate transfer body is detected by the detecting part in a position farthest from the detecting part among the developer images of different colors.

In the above-mentioned apparatus, a plurality of the image carriers is arranged along a rotational direction of the intermediate transfer body;

the primary transfer is made by overlapping the developer images of different colors from the image carriers onto the surface of the intermediate transfer body;

the estimating part may determine the distance from the first transfer position to the detecting position by the detecting part based on a time period until the developer image which undergoes the primary transfer onto the surface of the intermediate transfer body is detected by the detecting part in a position farthest from the detecting part among the developer images of different colors; and the estimating part may estimate based on a difference between the distance and the standard distance.

It is possible to assume, with high precision, the moving distance necessary for moving the developer image undergoing primary transfer to the intermediate transfer body from the detection position to the second transfer position.

In the above-mentioned method, when another developer image of a different color is transferred onto the surface of the intermediate transfer body without overlapping the developer image;

a position where the developer images are to be overlapped on the surface of the intermediate transfer body is corrected based on the difference of times when the developer images are detected by the detecting part;

the distance from the first transfer position to the detecting position detected by the detecting part is determined based on the time period from the time when the developer image undergoes the primary transferred to the time when detection is made by the detecting part; and the moving distance is estimated based on a difference between the distance and a standard distance.

In the above-mentioned apparatus, a position where the developer images are to be overlapped on the surface of the intermediate transfer body is corrected based on the difference of times when the developer images are detected by the detecting part;

the estimating part determines the distance from the first transfer position to the detecting position detected by the detecting part based on the time period from the time when the developer image undergoes the primary transferred to the time when detection is made by the detecting part; and the estimating part estimates the moving distance based on a difference between the distance and a standard distance.

It is possible to reduce waiting time until the image can be formed by assuming the moving distance in parallel with a process for correcting the positions of the developer images are overlapped on the surface of the intermediate transfer body.

In the above-mentioned method, if one or more of the image carriers transferring the developer image are made to come in contact with the surface of the intermediate transfer body and another one or more of the image carriers are made to be separated from the surface of the intermediate transfer body; and the moving distance is estimated and the transfer member is conveyed to the second transfer position when the contact situation of multiple image carriers and the surface of the intermediate transfer member is changed.

In the above-mentioned apparatus, one or more of the image carriers transferring the developer image are made to come in contact with the surface of the intermediate transfer body and another one or more of the image carriers are made to be separated from the surface of the intermediate transfer body;

the moving distance is estimated by the estimating part when the contact situation of multiple image carriers and the surface of the intermediate transfer member is changed; and the adjusting part adjusts time for conveying the transfer member to the second transfer position based on the moving distance.

It is possible to prevent the position shift of the developer image accompanying the existence of the image carrier contacting the surface of the intermediate transfer body and the number of contacts.

In the above-mentioned method, a periphery temperature of the intermediate transfer body is detected when the moving distance is estimated so as to be defined as a standard temperature; and in a case where a difference between the periphery temperature and the standard temperature becomes equal to or greater than a designated value, the moving distance is newly estimated and time for conveying the transfer member to the second transfer position is estimated.

The above-mentioned apparatus may further include a temperature detecting part configured to detect a periphery temperature of the intermediate transfer body.

In the above-mentioned apparatus, a periphery temperature of the intermediate transfer body is detected so as to be defined as a standard temperature, when a time for requiring to the rotation of the intermediate transfer body from the first transfer position to the second transfer position is estimated by the estimating part; and in a case where a difference between the periphery temperature and the standard temperature becomes equal to or greater than a designated value, the moving distance is newly estimated by the estimating part and time for conveying the transfer member to the second transfer position is adjusted by the adjusting part based on the moving distance.

It is possible to prevent the position shift of the developer image based on expansion and contraction of the intermediate transfer body due to the change of the periphery temperature.

In the above-mentioned method, in a case where an estimated value of the moving distance is out of an allowable area, a predetermined value is substituted as the moving distance instead of the estimated value so that a time for conveying the transfer member to the second transfer position is adjusted.

In the above-mentioned apparatus, in a case where an estimated value of the moving distance estimated by the estimating part is out of an allowable area, a predetermined value is substituted as the moving distance instead of the estimated value so that a time for conveying the transfer member to the second transfer position is adjusted.

It is possible to prevent the position shift of the developing image from becoming large in a case where the developing image is not detected due to some reason.

In the above-mentioned method in a case where an estimated value of the moving distance is out of an allowable range, a density of the developer image undergoing the primary transfer onto the surface of the intermediate transfer body is increased.

The above-mentioned may further include a density adjusting part configured to increase a density of the developer image undergoing the primary transfer onto the surface of the intermediate transfer body in a case where an estimated value of the moving distance is out of an allowable range, is increased.

In a case where the developer image is not detected due to the density being low, it is possible to detect the developer image by making the density high so that the position shift of the developing image can be prevented securely.

In the above-mentioned method, a time period for detecting by the detecting part from the time when the developer image undergoes the primary transfer is measured so that a moving distance calculated from the time period is set as the standard time.

The above-mentioned apparatus may further include a measuring part configured to measure the moving distance based on a time period for detecting by the detecting part from the time when the developer image undergoes the primary transfer.

In the above-mentioned apparatus, the moving distance measured by the measuring part is set as the standard time.

In a case where it is regarded that the perimeter length of the intermediate transfer body is not changed such that the image forming apparatus is used for the first time, the measured moving distance is regarded as the standard distance. Hence, it is possible to reduce the influence of an error due to shift for every device as compared to a case where the standard value is calculated by the setting value.

In the above-mentioned method, in a case where the intermediate transfer body is exchanged, the moving distance is calculated and the moving distance is set as the standard distance.

In the above-mentioned apparatus, the measuring part measures the moving distance in a case where the intermediate transfer body is exchanged.

It is possible to reduce the influence of an error due to unevenness of every intermediate transfer body.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teachings herein set forth.

This patent application is based on Japanese Priority Patent Application No. 2007-14871 filed on Jan. 25, 2007, the entire contents of which are hereby incorporated by reference.

What is claimed is:

1. An image forming method whereby in which an intermediate transfer body made of an endless flexible member is rotated, and an image is formed on a surface of a transfer member by undergoing a secondary transfer of a developer image onto a second transfer position from the intermediate transfer body to the transfer member, the developer image undergoing a primary transfer onto a first transfer position from an image carrier to a surface of the intermediate transfer body, the image forming method comprising:

a step of detecting the developer image on the surface of the intermediate transfer body by a detecting part provided between the first transfer position and the second transfer position;

a step of determining a distance from the first transfer position to a detecting position by the detecting part based on a time period from a time when the developer image undergoes the primary transfer to a time when detection is made by the detecting part;

a step of estimating a moving distance necessary for moving the developer image having undergone the primary transfer onto the intermediate transfer body from the detecting position to the second transfer position based on a difference between the distance and a preset standard distance; and a step of adjusting time for conveying the transfer member to the second transfer position based on the moving distance, wherein when another developer image of a different color is transferred onto the surface of the intermediate transfer body without overlapping the developer image;

a position where the developer images are to be overlapped on the surface of the intermediate transfer body is corrected based on the difference of times when the developer images are detected by the detecting part;

the distance from the first transfer position to the detecting position detected by the detecting part is determined based on the time period from the time when the developer image undergoes the primary transfer to the time when detection is made by the detecting part; and the moving distance is estimated based on a difference between the distance and a standard distance.

2. The image forming method as claimed in claim 1, wherein one or more of the image carriers transferring the developer image are made to contact the surface of the intermediate transfer body and another one or more of the image carriers are made to be separated from the surface of the intermediate transfer body; and the moving distance is estimated and the transfer member is conveyed to the second transfer position when the contact situation of multiple image carriers and the surface of the intermediate transfer member is changed.

3. The image forming method as claimed in claim 1, wherein a periphery temperature of the intermediate transfer body is detected when the moving distance is estimated so as to be defined as a standard temperature; and in a case where a difference between the periphery temperature and the standard temperature becomes equal to or greater than a designated value, the moving distance is newly estimated and a time for conveying the transfer member to the second transfer position is estimated.

4. The image forming method as claimed in claim 1, wherein, in a case where an estimated value of the moving distance is out of an allowable area, a predetermined value is substituted as the moving distance instead of the estimated value so that a time for conveying the transfer member to the second transfer position is adjusted.

5. The image forming method as claimed in claim 1, wherein, in a case where an estimated value of the moving distance is out of an allowable range, a density of the developer image undergoing the primary transfer onto the surface of the intermediate transfer body is increased.

6. The image forming method as claimed in claim 4, wherein a time period for detecting by the detecting part from the time when the developer image undergoes the primary transfer is measured so that a moving distance calculated from the time period is set as the standard time.

7. The image forming method as claimed in claim 6, wherein, in a case where the intermediate transfer body is exchanged, the moving distance is calculated and the moving distance is set as the standard distance.

8. An image forming apparatus in which an intermediate transfer body made of an endless flexible member is rotated, and an image is formed on a surface of a transfer member by undergoing a secondary transfer of a developer image onto a second transfer position from the intermediate transfer body to the transfer member, the developer image undergoing a primary transfer onto a fast transfer position from an image carrier to a surface of the intermediate transfer body, the image forming apparatus comprising:

a detecting part configured to detect the developer image on the surface of the intermediate transfer body by a detecting part provided between the first transfer position and the second transfer position;

an estimating part configured to determine a distance from the first transfer position to a detecting position by the detecting part based on a time period from a time when the developer image undergoes the primary transfer to a time when detection is made by the detecting part;

the estimating part configured to estimate a moving distance necessary for moving the developer image having undergone the primary transfer onto the intermediate transfer body from the detecting position to the second transfer position based on a difference between the distance and a preset standard distance; and an adjusting part configured to adjust time for conveying the transfer member to the second transfer position based on the moving distance, wherein a position where the developer images are to be overlapped on the surface of the intermediate transfer body is corrected based on the difference of times when the developer images are detected by the detecting part;

the estimating part determines the distance from the first transfer position to the detecting position detected by the detecting part based on the time period from the time when the developer image undergoes the primary transfer to the time when detection is made by the detecting part; and the estimating art estimates the moving distance based on a difference between the distance and a standard distance.

9. The image forming apparatus as claimed in claim 8, wherein one or more of the image carriers transferring the developer image are made to contact the surface of the intermediate transfer body and another one or more of the image carriers are made to be separated from the surface of the intermediate transfer body;

the moving distance is estimated by the estimating part when the contact situation of multiple image carriers and the surface of the intermediate transfer member is changed; and the adjusting part adjusts time for conveying the transfer member to the second transfer position based on the moving distance.

10. The image forming apparatus as claimed in claim 8, further comprising:

a temperature detecting part configured to detect a periphery temperature of the intermediate transfer body, wherein a periphery temperature of the intermediate transfer body is detected so as to be defined as a standard temperature, when a time for requiring a rotation of the intermediate transfer body from the first transfer position to the second transfer position is estimated by the estimating part; and in a case where a difference between the periphery temperature and the standard temperature becomes equal to or greater than a designated value, the moving distance is newly estimated by the estimating part and a time for conveying the transfer member to the second transfer position is adjusted by the adjusting part based on the moving distance.

11. The image forming apparatus as claimed in claim 8, wherein, in a case where an estimated value of the moving distance estimated by the estimating part is out of an allowable area, a predetermined value is exchanged as the moving distance instead of the estimated value so that a time for conveying the transfer member to the second transfer position is adjusted.

12. The image forming apparatus as claimed in claim 8, further comprising:

a density adjusting part configured to increase a density of the developer image undergoing the primary transfer onto the surface of the intermediate transfer body in a case where an estimated value of the moving distance is out of an allowable range, is increased.

13. The image forming apparatus as claimed in claim 11, further comprising:

a measuring part configured to measure the moving distance based on a time period for detecting by the detecting part from the time when the developer image undergoes the primary transfer;

wherein the moving distance measured by the measuring part is set as the standard time.

14. The image forming apparatus as claimed in claim 13, wherein the measuring part measures the moving distance in a case where the intermediate transfer body is exchanged.

* * * * *